US005230188A

United States Patent [19]

Nurse

[11] Patent Number: 5,230,188

[45] Date of Patent: Jul. 27, 1993

[54] BUILDING ENTRANCE BOOT DRAIN

[76] Inventor: Timothy H. Nurse, 1687 Pear Street, Victoria, B.C., Canada, V8P 2A5

[21] Appl. No.: 785,059

[22] Filed: Oct. 30, 1991

[51] Int. Cl.[5] ..... E04B 1/70

[52] U.S. Cl. ..... 52/169.5; 52/177; 210/163; 210/164; 34/202

[58] Field of Search ..... 52/169.5, 177, 664, 52/665, 668; 210/162; 34/202, 104

[56] References Cited

U.S. PATENT DOCUMENTS

| | | | |
|---|---|---|---|
| Re. 16,964 | 5/1928 | Nicholson | 52/177 |
| 2,550,400 | 4/1951 | Boosey | 210/163 |
| 2,701,027 | 2/1955 | Scoville | 210/163 |

FOREIGN PATENT DOCUMENTS

| | | | |
|---|---|---|---|
| 184287 | 5/1918 | Canada . | |
| 793525 | 9/1968 | Canada . | |
| 1029946 | 5/1974 | Canada . | |
| 2908549 | 3/1979 | Fed. Rep. of Germany | 210/164 |
| 1029295 | 1/1989 | Japan | 34/202 |

*Primary Examiner*—Carl D. Friedman
*Assistant Examiner*—Wynn E. Wood
*Attorney, Agent, or Firm*—Fetherstonhaugh & Company

[57] ABSTRACT

The building entrance boot drain is similar in function to a shower-base, but is recessed into the floor inside an entrance to a house or building. An expanded metal grate is supported by the receptacle. At the center of the base of the receptacle, an opening leads to suitable plumbing fixtures which form a water-trap and thence a drain to the building's water-waste system. Snow and ice, melting off winter boots placed on the building entrance boot drain, forms water which is conveniently drained away into the building's water-waste system.

4 Claims, 2 Drawing Sheets

BUILDING ENTRANCE BOOT DRAIN

TECHNICAL FIELD

This invention relates to the safe, convenient and efficient removal of water resulting from the melting of snow and ice brought indoors on winter boots.

BACKGROUND ART

Customarily wet, muddy or snow and ice covered boots, brought indoors, are removed from the feet of the wearer and are placed in a convenient location to drain and dry. Boots may be placed on an absorbent mat, a newspaper, a rubber mat, a plastic tray, a carpeted floor or a linoleum covered floor. Water from wet boots, or water resulting from snow and ice melting off the boots, soaks into, and eventually saturates pervious materials. In this saturated condition, newspapers must be lifted and discarded and absorbent mats and carpets must be dried. If this procedure is not followed, the constant presence of moisture may deteriorate the carpet and floor, and provide a breeding ground for bacteria and fungi. Rubber mats and plastic trays used to collect water draining off wet boots, must periodically be lifted, drained and cleaned. Wet boots or water from snow and ice covered boots which have been placed on a linoleum covered floor, forms a puddle of water which must be mopped up. Water lying on a linoleum floor causes that floor to be slippery thereby rendering it a safety hazard to people walking on that floor.

DISCLOSURE OF INVENTION

I have found that these disadvantages of water damage, poor hygiene and inconvenience may be overcome by providing a permanent receptacle for collecting and disposing of water draining off wet or muddy boots, and water formed when snow and ice melts off winter boots which have been brought indoors to room temperature. The receptacle is recessed into the floor and an expanded metal grate is fitted in such a way that the uppermost surface of the grate is one quarter of one inch below the surface of the surrounding floor, being supported by the receptacle. The base of the receptacle is graded slightly downwards from both ends and both sides towards the center of the base to enable water to drain to the center of the base. At the center of the base there is located an opening through which water flows into suitable plumbing fixtures which form a trap. This trap is the same as or similar to traps found beneath and attached to kitchen sinks. The trap employed as a part of this invention has a cleanout plug located at the lower extremity of it to enable mud, sand, silt or any other unwanted buildup of material to be removed from the trap. Drainage pipe connected to the trap drains water from the receptacle and the trap to the sewer or waste-water system of a house or building. Water draining off wet boots, drops through the holes in the expanded metal grate onto the base of the receptacle. The water then follows the grade of the base to it's center where it drops through the opening and is drained away through the trap and drainage pipe. For houses and buildings which are heated with a forced air heating system using ducts to convey warm air to outlets throughout the house or building, an optional model of the invention would be employed. This model would have an opening in the vertical wall of the receptacle to which a hot air duct may be connected. Warm air rising past boots placed on the grate would more rapidly melt ice and snow and dry the boots, thereby greatly enhancing the effectiveness of the invention. During times when the invention is not in use, a one quarter of one inch thick cover is placed over the expanded metal grate enabling the-full floor area of the entrance to be used for other purposes.

BRIEF DESCRIPTION OF DRAWINGS

In drawings which illustrate embodiments of the invention.

BEST MODE FOR CARRYING OUT INVENTION

Figure 1:
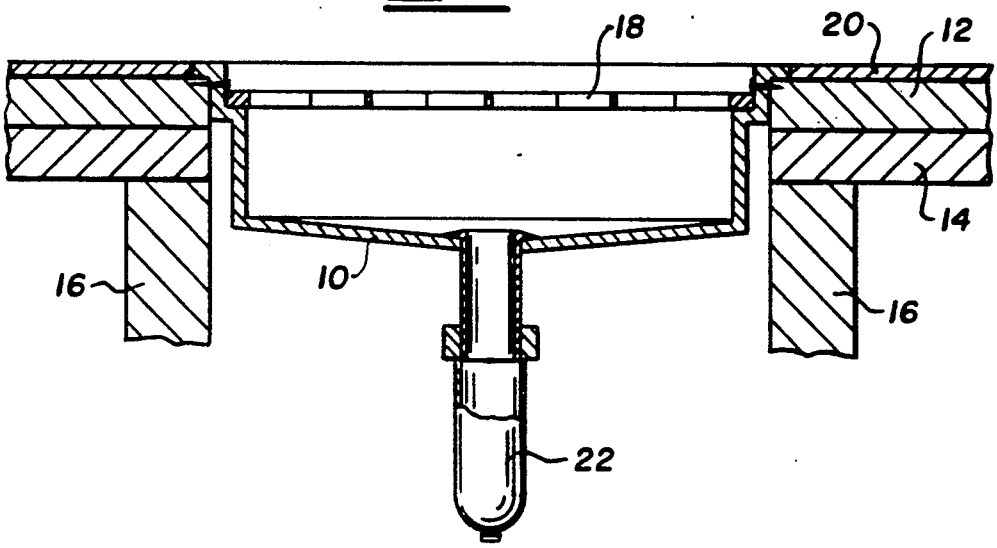
FIG. 1 is an elevation in section of one embodiment in a plane at rightangles to the direction of lay of the floor joists.
Figure 2:
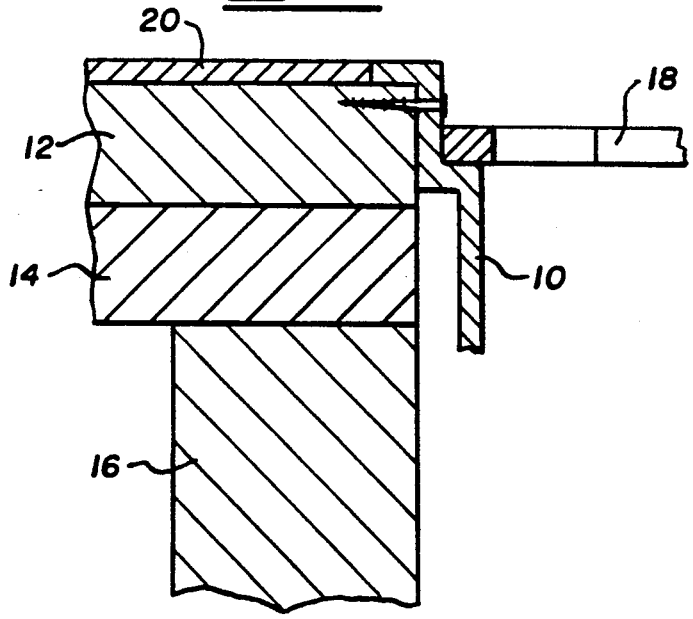
FIG. 2 is a detailed view of part of FIG. 1.
Figure 3:
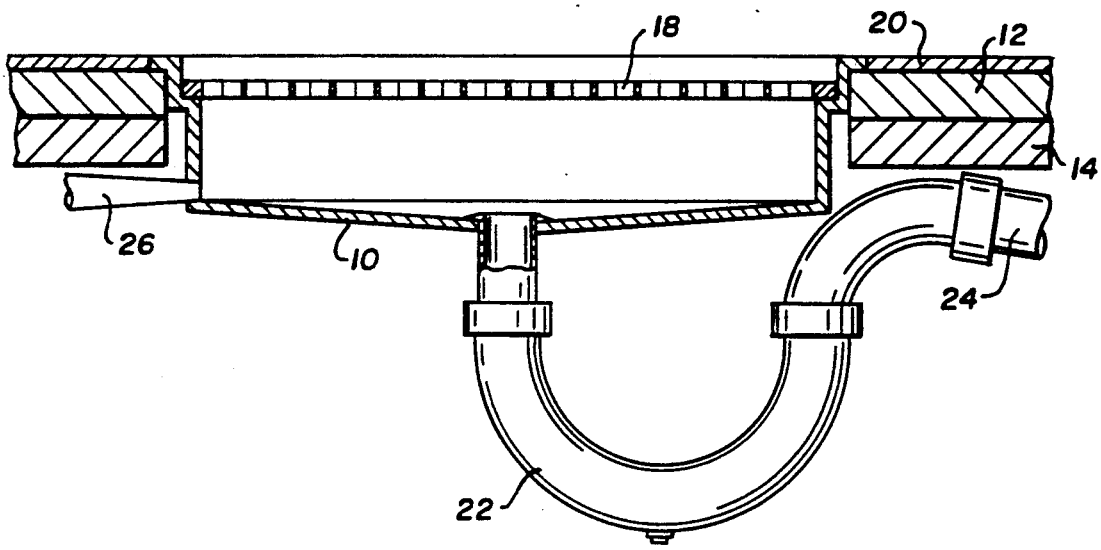
FIG. 3 is an elevation in section of one embodiment in a plane parallel to the direction of lay of the floor joists.
Figure 4:
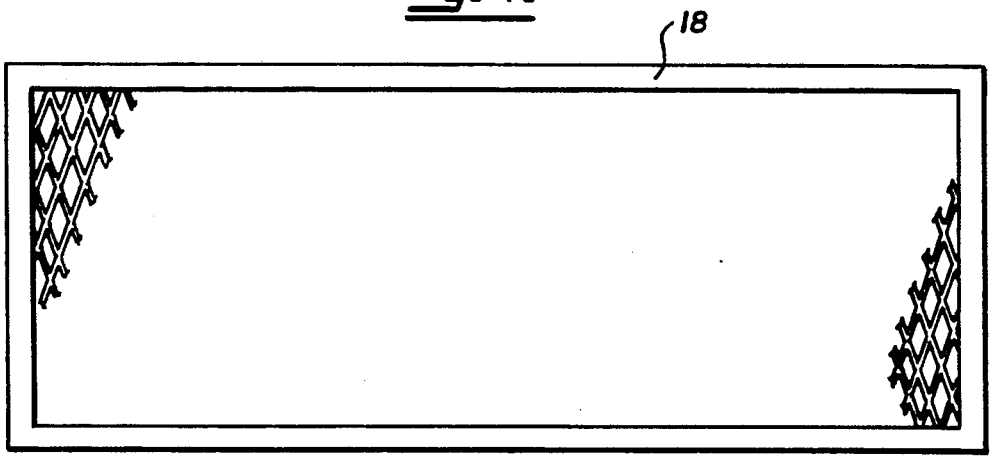
FIG. 4 is a top plan view of this embodiment.

The device comprises a receptacle 10, in FIGS. 1, 2 and 3, the extending lip of which is supported by the floor 12, which is supported by the subfloor 14, which in turn is supported by the joists 16. The expanded metal grate 18 is located at the correct level and is supported by the receptacle 10, as detailed in FIG. 2. The floor covering 20 meets flush with the moulded receptacle 10. The opening at the center of the base of the receptacle 10 is secured to plumbing fixtures 22 which form a water-trap. The water-trap 22 is in turn plumbed into the drainage pipe 24, which proceeds to and is plumbed into the building's water-waste system. FIG. 4 is a top plan view of the expanded metal grate 18, emplaced in the floor. In FIG. 3, an adapter 26 enables a heat source such as a forced-air heating duct or an electric heater to be connected to the receptacle 10.

The dimensions of length and breadth of the device may vary subject to the floor area available for it's installation. A design for a new building may include provision for the installation of the device. In this instance the floor joists may be located in such a way as to accommodate the installation of a unit of predetermined length and breadth. Installation of the device in an existing building may require the choice of a model the length and breadth of which would allow it to fit between the existing floor joists. An appropriately sized section of floor covering, floor and subfloor must be removed in either a new or existing building to accommodate the length and breadth of the unit chosen for installation. Having provided an opening of appropriate length and breadth in the floor, the receptacle 10 may be placed in position by lowering the end which embodies the heating adapter into the opening first. The device may then be moved laterally in the direction of the duct adapter and further lowered into the correct position. The receptacle 10 may be permanently secured in position by employing 3/4 inch flathead self-tapping socket-head screws which should be screwed into the floor horizontally through pre-drilled holes in the receptacle 10.

The receptacle 10 may be constructed of concrete. In this instance the receptacle may be a part of a concrete floor being moulded into the floor at the time that the concrete floor is poured. The walls and base of the receptacle would consist of cast concrete, and the grate would be supported by a flange moulded into the concrete wall of the receptacle.

The invention may be further used to dry articles of clothing such as hats, gloves and mitts. Other articles may be placed on the invention for the purposes of melting snow and ice from the articles and drying the articles. Such articles may include sports equipment, tools and firewood.

The embodiments of the present invention in which an exclusive property or privilege is claimed are defined as follows:

1. A building entrance boot drain comprising:

a receptacle installed in a recess in a building floor, the receptacle having a floor, sides and an open top, the floor having sloping portions to a drain opening such that liquid within the receptacle flows to the drain opening;

a heat source located in at least one side of the receptacle;

a grate positioned on the open top of the receptacle and supported thereon, and a U-shaped drain trap connected to the drain opening for attachment to a drain.

2. The boot drain according to claim 1 wherein the heat source is an air vent connected to a forced air supply.

3. The boot drain according to claim 1 wherein the receptacle is substantially rectangular in shape.

4. The boot drain according to claim 1 wherein the receptacle is installed in a recess in the building floor, wherein the top of the grate is at a level approximately one quarter of an inch below the surface of said building floor.

* * * * *